US009752747B2

(12) United States Patent
Achterhuis

(10) Patent No.: US 9,752,747 B2
(45) Date of Patent: Sep. 5, 2017

(54) LED-LIGHT

(71) Applicant: Hemsson Holding B.V., Enter (NL)

(72) Inventor: Jeroen Achterhuis, Wierden (NL)

(73) Assignee: HEMSSON HOLDING B.V., Enter (NL)

( * ) Notice: Subject to any disclaimer, the term of this patent is extended or adjusted under 35 U.S.C. 154(b) by 0 days.

(21) Appl. No.: 15/033,533

(22) PCT Filed: Oct. 29, 2014

(86) PCT No.: PCT/NL2014/050752

§ 371 (c)(1),
(2) Date: Apr. 29, 2016

(87) PCT Pub. No.: WO2015/065186

PCT Pub. Date: May 7, 2015

(65) Prior Publication Data

US 2016/0252217 A1 Sep. 1, 2016

(30) Foreign Application Priority Data

Oct. 29, 2013 (NL) ..... 2011690

(51) Int. Cl.

| | |
|---|---|
| ***F21V 3/00*** | (2015.01) |
| ***F21S 9/03*** | (2006.01) |
| ***F21K 9/23*** | (2016.01) |
| ***F21K 99/00*** | (2016.01) |
| ***F21V 23/04*** | (2006.01) |

(Continued)

(52) U.S. Cl.

CPC ..... *F21V 3/00* (2013.01); *F21K 9/1355* (2013.01); *F21K 9/23* (2016.08); *F21K 9/232* (2016.08); *F21K 9/235* (2016.08); *F21K 9/238* (2016.08); *F21S 9/037* (2013.01); *F21V 23/0435* (2013.01); *F21V 23/06* (2013.01);

(Continued)

(58) Field of Classification Search

CPC ..... F21V 3/00; F21V 23/0435; F21V 23/06; F21V 25/00; F21S 9/037; F21K 9/23; F21K 9/1355; F21K 9/232; F21K 9/238; F21K 9/235

See application file for complete search history.

(56) References Cited

U.S. PATENT DOCUMENTS 8,333,481 B2 * 12/2012 Deng ..... H05B 35/00 315/86

2008/0092800 A1 4/2008 Smith et al.

(Continued)

FOREIGN PATENT DOCUMENTS

DE 20 2008 013 699 U1 1/2009
EP 2 378 188 A2 10/2011

*Primary Examiner* — Thomas M Sember

(74) *Attorney, Agent, or Firm* — Birch, Stewart, Kolasch & Birch, LLP

(57) ABSTRACT

A LED-light includes a light frame and a light base connected with a first end of the light frame. The light base is of substantially cylindrical design and is provided with an Edison thread which extends concentrically around a central axis of the light base. Further, the LED-light includes a number of LEDs mounted in or on the light frame and at least one photovoltaic cell mounted in or on the light frame. Connected with the light frame or the light base is a battery, as well as an electric circuit. Connected to the electric circuit are the number of LEDs, the battery and the at least one photovoltaic cell.

14 Claims, 7 Drawing Sheets

(51) Int. Cl.

| | |
|---|---|
| ***F21V 23/06*** | (2006.01) |
| ***F21V 25/00*** | (2006.01) |
| ***F21K 9/232*** | (2016.01) |
| ***F21K 9/238*** | (2016.01) |
| ***F21K 9/235*** | (2016.01) |
| *F21Y 115/10* | (2016.01) |
| *F21Y 107/30* | (2016.01) |
| *F21Y 101/00* | (2016.01) |

(52) U.S. Cl.
CPC ..... *F21V 25/00* (2013.01); *F21Y 2101/00* (2013.01); *F21Y 2107/30* (2016.08); *F21Y 2115/10* (2016.08)

(56) References Cited

U.S. PATENT DOCUMENTS

| | | | | |
|---|---|---|---|---|
| 2012/0026726 | A1 | 2/2012 | Recker et al. | |
| 2012/0126699 | A1 | 5/2012 | Zittel | |
| 2012/0293982 | A1* | 11/2012 | Labans ..... | H01R 13/6675 362/95 |
| 2012/0327660 | A1 | 12/2012 | Lin | |
| 2013/0223049 | A1 | 8/2013 | Katsaros | |

* cited by examiner

LED-LIGHT

FIELD

The invention relates to a LED-light.

BACKGROUND

From practice, LED-lights are known. LED is an acronym for light emitting diode. Given an equal light output, LEDs consume much less energy than conventional incandescent light bulbs. The replacement of incandescent light bulbs with a different type of lighting, such as for instance LED lighting, is presently receiving particular attention in connection with energy saving. It is already known that such LED-lights are provided with a base which is provided with Edison thread and which can be received in a normal light holder in which formerly the normal incandescent light bulbs were received. Such LED-lights were provided with current via the light holder and fed by the electricity grid. Switching the known LED-light on and off is done by turning over the normal mains switch whereby, depending on the position of the mains switch, current or no current is supplied to the LED-light.

From practice, also LED lighting is known that is provided with LEDs, a battery and with at least one photovoltaic cell by means of which the battery can be charged. Such LED lighting finds application especially in the open air, as in gardens and parks. In that known lighting, the LEDs are connected to the battery and can be switched on and off at will, for instance with the aid of a switch on the LED lighting. Such LED lighting, however, is generally implemented as an independently functioning light fitting which, for instance, is placed in the garden. The known LED lighting provided with photovoltaic cells is not suitable to be mounted in a generally present normal light holder which is provided with Edison thread. As a result, when a user wishes to change over from lighting energized by the electricity grid to lighting energized by solar energy, this user must place the new independently functioning fittings and remove the old fittings connected to the electricity grid. Since lighting fixtures are generally costly, it is for reasons of cost that many users find the decision to replace the lighting fixtures energized by the electricity grid with fixtures energized by solar energy so hard that such replacement is refrained from. The introduction of lighting energized by solar energy in gardens and parks is thereby impeded.

SUMMARY OF THE INVENTION

The object of the invention is to provide a solution to the above-outlined issues.

To this end, the invention provides a LED-light which comprises:

- a light frame;
- a light base which is connected with a first end of the light frame, wherein the light base is of substantially cylindrical design and has a central axis, wherein the light base is provided with Edison thread extending concentrically around the central axis, or wherein the light base is provided with a bayonet fastener;
- a number of LEDs mounted in or on the light frame;
- at least one photovoltaic cell which is mounted in or on the light frame;
- a battery which is connected with the light frame or the light base;

- an electric circuit which is connected with the light frame or the light base and to which the number of LEDs, the battery and the at least one photovoltaic cell are connected.

Such a LED-light can be screwed into a socket of a conventional, mains-energized light fitting. The existing light fittings therefore do not need to be replaced. Only the incandescent light bulbs or LED-lights present therein need to be replaced by a light according to the invention. The conventional light fitting does not need to be used anymore to provide the LEDs with current when lighting is desired. The conventional light fitting can just serve as a holder of the LED-light according to the invention.

In an embodiment of the invention, on the light base a contact may be provided which is electrically conductive and is in communication with the electric circuit, wherein the electric circuit is configured to place the LEDs into connection with the battery, so that the LEDs burn when there is a voltage on the contact, and wherein the electric circuit is configured to break the connection between the battery and the LEDs when there is no voltage on the contact, so that the LEDs do not burn.

A thus-designed LED-light can still be switched on with the normal mains switch. When lighting is desired, the user will, as he used to do, operate the mains switch which is associated with the respective lighting fixture. Thereupon a voltage is applied to the contact. The electric circuit sees this voltage and switches the LEDs into connection with the battery. Accordingly, no current flows from the mains to the LEDs. The voltage on the contact merely serves to establish an electrical connection between the battery and the LEDs through an appropriate action of the electric circuit to that effect.

Further elaborations are described in the subclaims, and will hereinafter be clarified further, on the basis of an exemplary embodiment.

DETAILED DESCRIPTION

Figure 1:
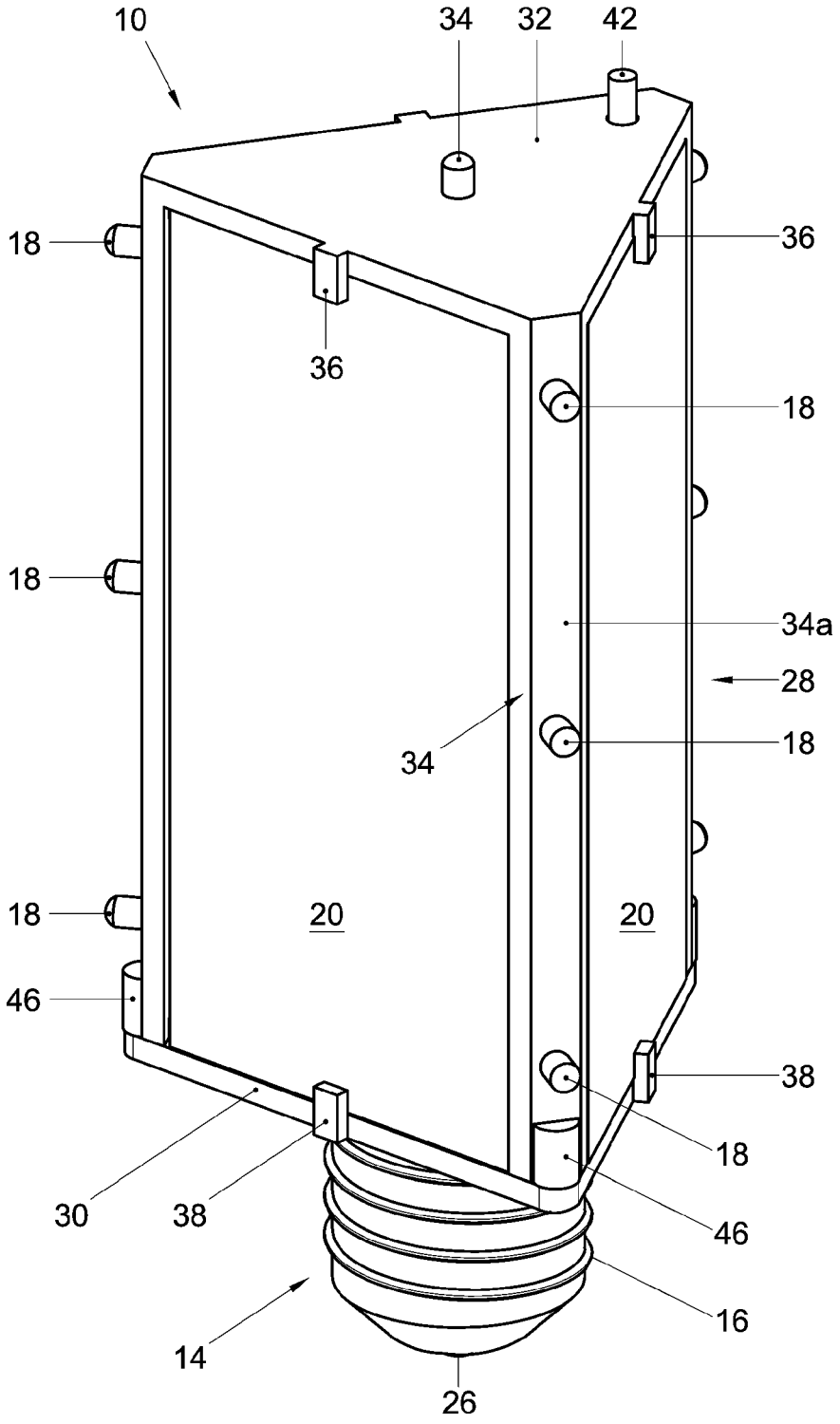
FIG. 1 shows a perspective view of an exemplary embodiment of a LED-light.
Figure 2:
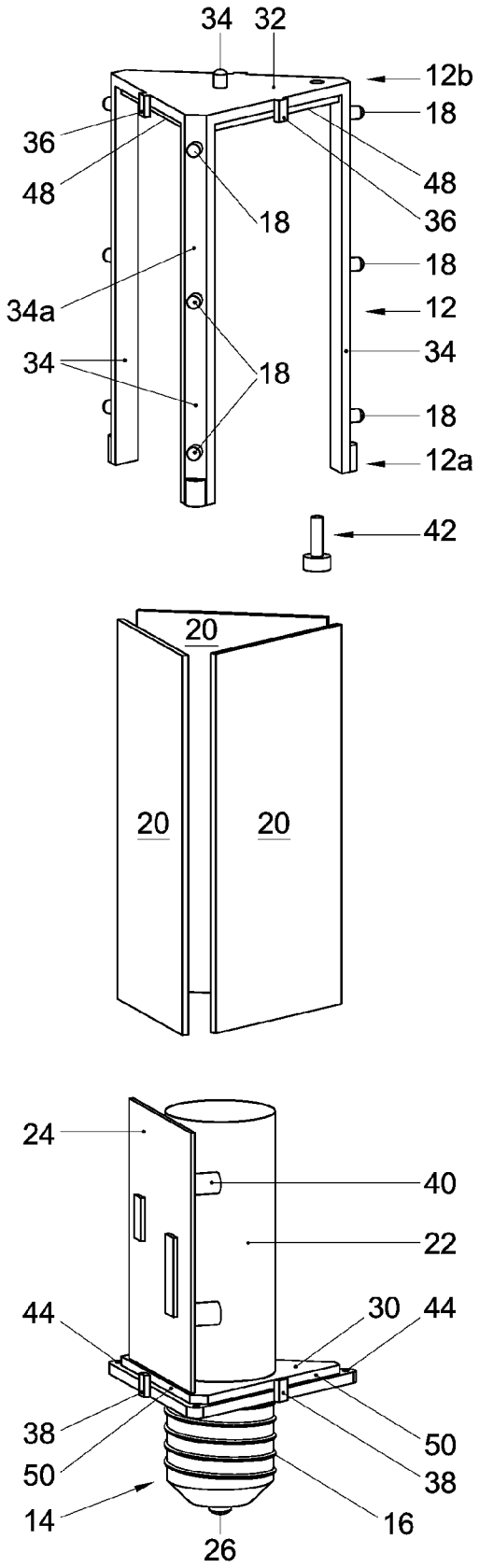
FIG. 2 shows an exploded view of the exemplary embodiment represented in FIG. 1.
Figure 3:
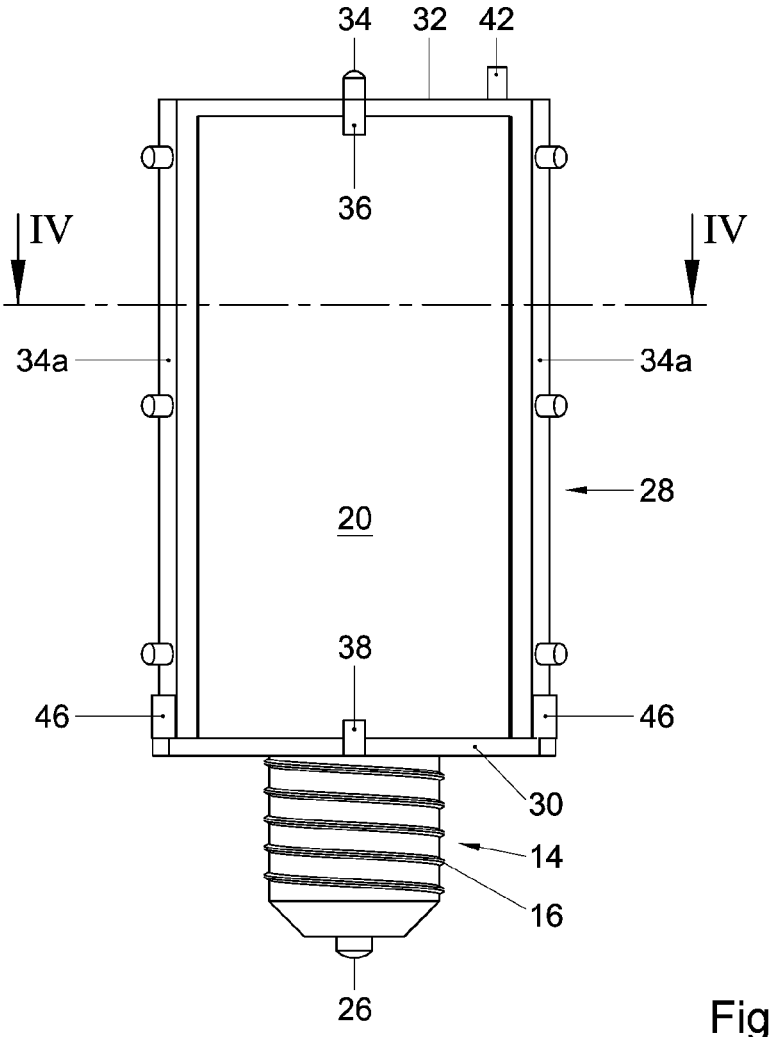
FIG. 3 shows a side view of the exemplary embodiment represented in FIG. 1.

Below, the invention and various embodiments thereof will be discussed with reference to the drawing. It is pointed out that the drawing merely shows an example incorporating at least a number of the embodiments to be described hereinafter. However, the embodiments may also be embodied in a different manner than shown in the example of the figures. The figures are for clarification only. The various embodiments can be applied independently of each other but can also be combined with each other. In the following detailed description and the claims, the reference numerals only serve for clarification and by no means limit the invention.

In the most general terms, the LED-light 10 comprises a light frame 12 and a light base (cap) 14 which is connected with a first end 12*a* of the light frame 12. The light base 14 is of substantially cylindrical design and has a central axis L. The light base is provided with Edison thread 16 which extends concentrically around the central axis L, or is provided with a bayonet fastener. Further, the LED-light 10 comprises a number of LEDs 18, mounted in or on the light frame 12, and at least one photovoltaic cell 20 which is mounted in or on the light frame 12. Connected with the light frame 12 or the light base 14 is a battery 22, as well as an electric circuit 24. Connected to the electric circuit are the number of LEDs 18, the battery 22 and the at least one photovoltaic cell 20.

The advantages of such a LED-light 10 reside in the feature that it can be screwed into a normal light fitting already present. The LED-light 10 is no longer dependent on the mains to illuminate the surroundings. All energy that is needed to have the LEDs burn can be generated by the at least one photovoltaic cell 20 which charges the battery 22 when the sun shines or sufficient light falls on the photovoltaic cell 20. When it gets dark, the energy stored in the battery 22 is used for causing the LEDs 18 to burn. Thus, a LED-light 10 is provided which does not need to draw current from the mains anymore and which can yet be secured in lighting fixtures already present by screwing them with the aid of the light base provided with Edison thread or bayonet fastener into the socket of the light fitting already present.

In an embodiment, of which an example is shown in the figures, on the light base 14 a contact 26 may be provided which is electrically conductive and which is in communication with the electric circuit 24. The electric circuit 24 can then be configured to place the LEDs 18 into connection with the battery 22, so that the LEDs 18 burn when there is a voltage on the contact 26. Further, the electric circuit may be configured to break the connection between the battery 22 and the LEDs 18 when there is no voltage on the contact 26, so that the LEDs do not burn.

Thus, by operating the light switch associated with the light fitting, the LED-light 10 can be switched on and off while yet no current is taken off the mains to cause the LEDs 18 of the LED-light to burn. The manner of operation with such an embodiment remains the same for the user, while for the lighting in question no energy is withdrawn from the mains anymore.

In an embodiment, of which an example is shown in the figures, the Edison thread 16 may be of the type E27 according to IEC 60061-1 7004-21 or DIN 49620 or of the type E14 according to IEC 60061 7004-23 or DIN 49615.

These two types of Edison thread are the most-used in 220-230 V networks and most light fittings in those areas are provided with sockets having such thread. Accordingly, the light according to this embodiment can be used in most available light fittings.

In an alternative embodiment, of which no example is shown, the bayonet fastener of the light base 14 may be of the type B15d according to IEC 60061-1 (7704-11) or DIN 49721 or of the type B22d according to IEC 60061-1 (7004-10).

These two types of bayonet fasteners are also much-used in 220-230 V networks. Accordingly, this embodiment can be used in many available light fittings.

Figure 4:
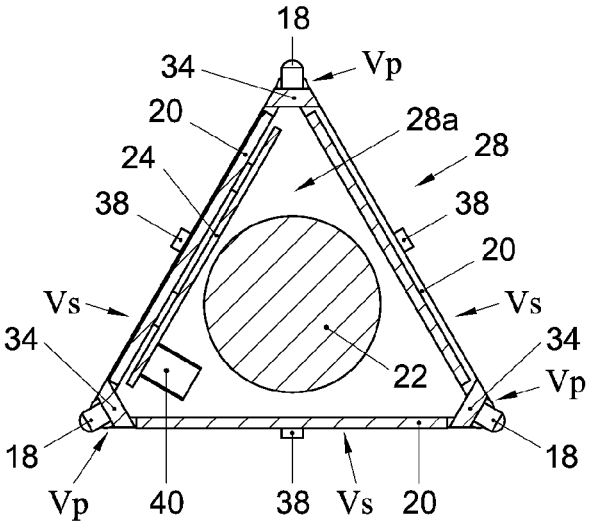
FIG. 4 shows a cross-sectional view taken along line IV-IV in FIG. 3.
Figure 5:
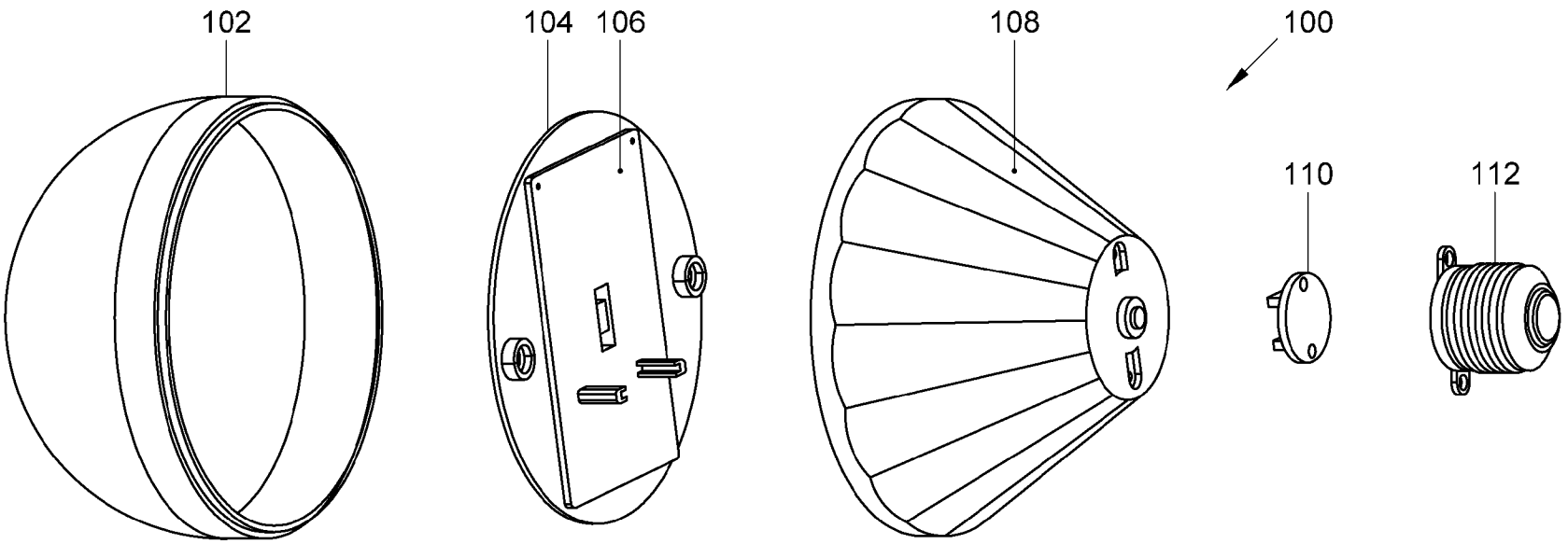
FIG. 5 shows a perspective, exploded view of a second exemplary embodiment of a LED-light.
Figure 6:
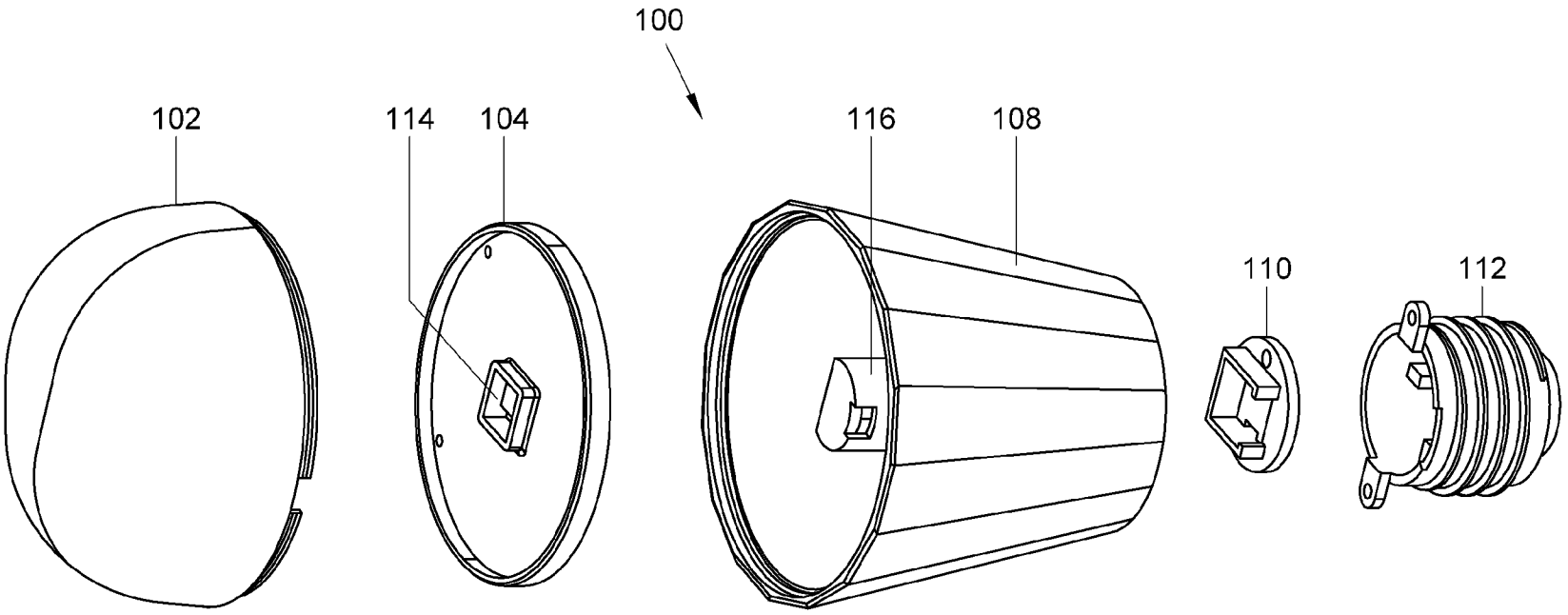
FIG. 6 shows a perspective view of the exemplary embodiment of FIG. 5 seen from a different viewpoint.
Figure 7:
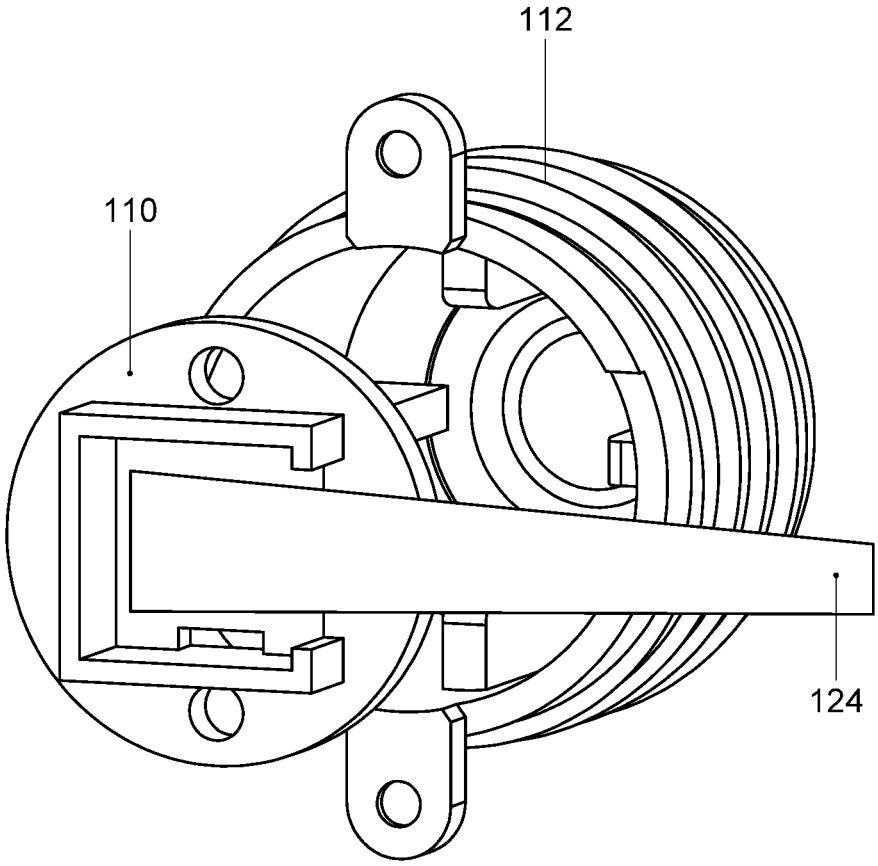
FIG. 7 shows the cap with the battery space closing element of the exemplary embodiment represented in FIGS. 5 and 6.
Figure 8:
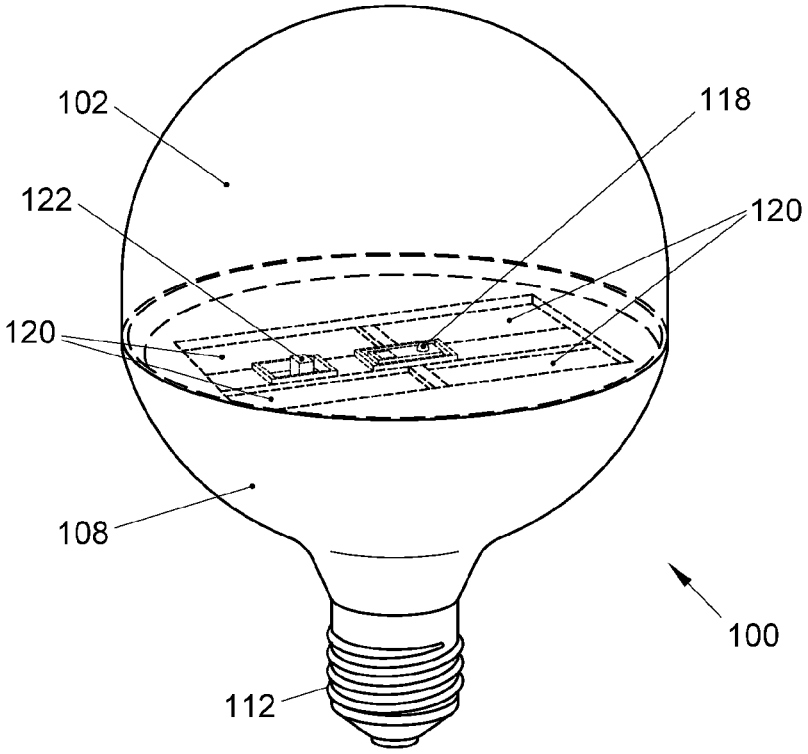
FIG. 8 shows a perspective view of a similar exemplary embodiment to that represented in FIGS. 5 and 6.
Figure 9:
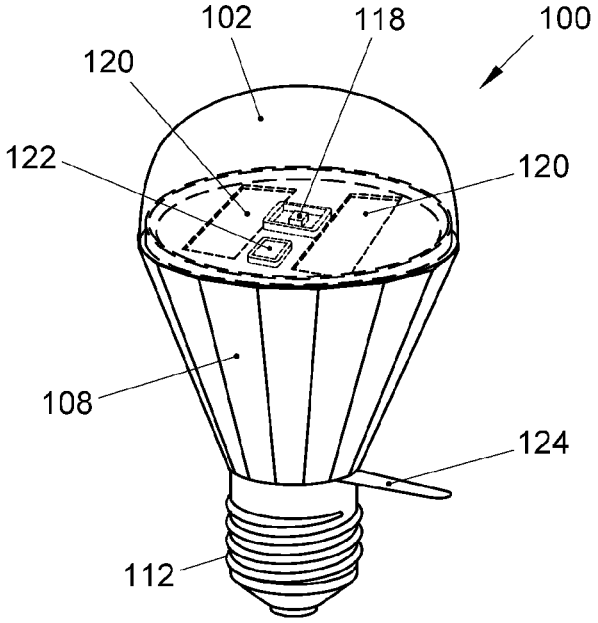
FIG. 9 shows a perspective view of the exemplary embodiment of FIGS. 5 and 6 in assembled condition.

In an embodiment, of which an example is shown in the figures, the light frame 12, together with the at least one photovoltaic cell 20 mounted thereon, can form a light body 28 having a light body interior 28*a* (see FIG. 4). In the light body interior 28*a*, the battery 22 and the electric circuit 24 may be included. The light body 28, viewed in cross-sectional plane IV-IV extending perpendicular to the axis L, can have a substantially polygonal cross section which comprises polygon sides Vs and polygon angles Vp. The polygon angles Vp may be chamfered. The LEDs 18 may be mounted on the parts of the light frame 12 that correspond to the chamfered polygon angles Vp. The photovoltaic cells 20 can correspond to the polygon sides Vs.

In a thus-designed embodiment, there is always one of the photovoltaic cells 20 capturing sufficient light to charge the battery 22. This is because there is always one of the photovoltaic cells 20 facing the sun or the light sufficiently.

In an embodiment, of which an example is shown in the figures, the polygonal cross section can be a triangular cross section.

Such an embodiment constitutes a fine compromise between the number of solar cells and the extent to which there is always one of the solar cells facing the light or the sun.

In an embodiment, of which an example is shown in the figures, the light base 14 with the Edison thread 16 may be manufactured from plastic. Such a light base does not conduct electricity. This prevents electricity being drawn from the mains, or the light frame 12 becoming live.

In an embodiment, of which an example is shown in the figures, the light base 14 can comprise a bottom plate 30 with the aid of which the light base 14 is detachably connected with the first end 12*a* of the light frame 12.

In the example shown, the connection can be effected with screws, which extend through holes 44 at the angles of the bottom plate 30 and which engage in screw bushes 46 of the frame 12. It is also possible, however, that the connection is effected by means of a snap connection or that the bottom plate 30 is connected with the light frame by means of glue.

In an embodiment, of which an example is shown in the figures, the light frame 12 has a second end 12*b* which is opposite to the first end 12*a*, the second end 12*b* being closed off by an end wall 32. With such an end wall 32, the light body interior 28*a* is closed off from the external world, to the effect that the light body interior, and the battery 22 and electric circuit 24 arranged therein, are not directly accessible to a user of the light 10.

In an embodiment, of which an example is shown in the figures, at least one LED 34 may be mounted on the end wall 32. In such an embodiment, light is emitted not only in radial direction, viewed from the central axis L, but also in the axial direction of the central axis L. Thus, a distribution of light can be obtained that exhibits many similarities to a conventional incandescent light bulb.

In an embodiment, of which an example is shown in the figures, the light frame 12 can comprise a number of profile parts 34 extending parallel to the central axis, which are connected in one piece with the end wall 32 and which extend from the second end 12*b* to the first end 12*a* of the light frame 12. The above-mentioned number of LEDs 18 can be placed on sides 34*a*, remote from the central axis L, of these profile parts 34.

In this embodiment, the light emitted by the LEDs 18, viewed from the central axis L, radiates especially in radial direction.

In an embodiment, of which an example is shown in the figures, between each pair of neighboring profile parts 34 a photovoltaic cell 20 may be arranged.

Thus, in an efficient manner, the light body 28 is formed, which has a polygonal configuration. In the example shown, this polygonal configuration is a triangular configuration. It will be clear, however, that possibilities include square, pentagonal, hexagonal or higher polygonal configurations, with the number of angles and the number of photovoltaic cells matching.

In an embodiment, of which an example is shown in the figures, the end wall 32 may be provided, between each neighboring pair of profile parts 34, with at least one mounting lug 36. In such an embodiment, also the bottom plate 30 may be provided, between each neighboring pair of profile parts 34, with at least one mounting lug 38. The mounting lugs 36, 38 can engage a front side of an associated photovoltaic cell 20 for mounting the respective photovoltaic cell 20 in the light frame 12.

Both the end wall 32 and the bottom plate 30 may be provided with upstanding edges 48 and 50, respectively, proximal to the light body interior 28*a*, against which the sides of the photovoltaic cells 20 proximal to the light body interior 28*a* can abut. Thus, the photovoltaic cells 20 can be fixed between the upstanding edges 48, 50 and the mounting lugs 36, 38.

In an embodiment, of which an example is shown in the figures, the LED-light 10 can comprise a wireless receiver 40 which is configured for wireless communication with a transmitter (not shown). The wireless receiver 40 can be part of the electric circuit 24. And the electric circuit 24 may be configured to switch the LEDs 18, 34 on and off depending on a signal delivered by the wireless receiver 40.

The receiver 40 can be, for instance, an infrared receiver or a receiver 40 which is configured for receiving other electromagnetic radiation, such as, for instance, radio waves.

In an embodiment, of which an example is shown in the figures, the LED-light can comprise a switch 42 which is arranged on the light frame 12 or the light base 14, 30 and which is part of the electric circuit 24. In such an embodiment, the electric circuit 24 may be configured to switch the LEDs 18, 34 on and off depending on the position of the switch 42.

In an embodiment of the LED-light 10, the light base 14 may be provided with electrically conductive contacts. The electric circuit 24 may then be configured to place the battery 22 into connection with the contacts when the amount of stored energy in the battery 22 is below a first threshold value. Under those circumstances, the battery 22 will be charged via the mains. Further, the electric circuit 24 may be configured to break the electrical connection between the battery 22 and the contacts when the amount of stored energy in the battery 22 is above a second threshold value. What is thereby effected is that the withdrawal of energy from the mains is ceased when the energy level in the battery 22 is sufficient. When there is sufficient ambient light, the battery 22 will be charged mainly via the at least one photovoltaic cell 20. However, when there is insufficient ambient light, and the energy level in the battery 22 falls below the first threshold value mentioned, energy can be taken off the mains to ensure that the light continues to function in that circumstance as well.

Such an embodiment provides for a much lower current consumption than a normal LED-light without photovoltaic cells. Moreover, such a LED-light 10 can also be used indoors because even when ambient light is insufficient the LED-light 10 yet continues to function.

In an embodiment of the LED-light 10, the battery 22 can be removable. As a result, the battery 22, for instance when it is empty, can be exchanged for a full battery 22. The empty battery 22 can then, for instance, be charged in a charging unit.

In an embodiment of the LED-light 10, it can be provided with a supply adapter connection which is arranged for connection of an external supply adapter for the purpose of charging the battery 22. When the battery 22 proves to be empty, the battery 22 can then be recharged by connecting the supply adapter to the LED-light 10. The LED-light 10 then does not need to be taken out of the socket of the light fitting.

In an embodiment of the LED-light 10, the at least one photovoltaic cell may be in a plane extending perpendicular to the central axis L, with a light-sensitive surface of the photovoltaic cell facing away from the light base 14. The LEDs 18 can then be so disposed as to radiate at least in the direction of the central axis L, more specifically such that the radiation direction points substantially away from the light base 14. Possibly, a transparent cover or milk glass cover may be placed over LEDs 18. When the light base 14 is placed in a socket which is so positioned that the LED-light 10 is above the socket, the light will therefore radiate substantially upwards. Such a light is especially intended for atmospheric lighting, whereby light is diffused in the room via the ceiling.

The examples represented in FIGS. 5-9 incorporate various embodiments of the invention.

According to a first embodiment, of which various examples are shown in FIGS. 5-9, the light frame 108 may, at a first end thereof, be detachably connected with the light base (cap) 112. The light frame 108 may then be a single injection-molded piece which is further provided with a battery chamber 116. The battery chamber is provided, near the first end of the light frame 108, with a battery chamber opening via which a battery is insertable into the battery chamber 116. The battery chamber opening is closable with the light base 112 detachably connected with the light frame 108.

This embodiment is relatively simple to manufacture and provides the possibility for a user to replace the battery when it has reached the end of its useful life.

In an embodiment, of which various examples are shown in FIGS. 5-9, the light frame 108 can have a second end which is remote from the light base 112. The LED-light 100 can further comprise a light-transmitting light top 102 which is connected with the second end of the light frame 108. The light-transmitting light top 102 has a substantially spherical segment-shaped configuration. Due to this spherical segment-shaped configuration, this embodiment of the LED-light 100 has the same appearance as a conventional incandescent light bulb, and the light emitted by the LEDs 118 radiates over a large range of directions.

In an embodiment, the LED-light 100 can comprise a substantially plate-shaped support element 104 which is included in the light frame 108 and which is provided with at least one opening 114. The plate-shaped support element 104 has two opposite main surfaces, a first of which faces the light base 112 and a second of which faces the light top 102. The electric circuit 106 is mounted on the plate-shaped support element 104 on the first side of the support element. The LEDs 118 mounted on the electric circuit extend through the above-mentioned, associated at least one opening 114 in the support element 104, such that the light generated in use by the LEDs 118 falls directly on the inner side of the light top 102. The at least one photovoltaic cell 120 is mounted on the second side, facing the light top 102, of the plate-shaped support element 104, such that outside light falls via the light-transmitting light top 102 onto the at least one photovoltaic cell 120.

Such an embodiment possesses the desired functionality of rechargeability with the aid of solar energy while yet having an appearance that substantially corresponds to that of a conventional pear-shaped light bulb.

In an embodiment, of which different examples are shown in FIGS. 5 to 9, the light base 112 may further be provided with a contact plate 110 which is connected with the light base 112 and which constitutes the closure of the battery chamber 116 and against which a battery placed in the battery chamber abuts by one end so as to form an electrical contact. The contact plate 110 is connected via an electrically conductive lead with the electric circuit 106 for energizing the electric circuit 106 by means of the battery and for charging the battery by means of the at least one photovoltaic cell 120.

In an embodiment, between the contact plate 110 and a battery placed in the battery chamber, an electrically insulating pull tab 124 may be provided. Prior to the LED-light 100 being put into use, such a pull tab 124 breaks the electrical contact between the battery and the contact plate 110. What is thus prevented, prior to the light being put into use, is that the battery already runs down in the package and the LED-light 100 already burns in the package. The pull tab 124 is engageable from an exterior side of the LED-light 100, allowing it to be pulled away to establish electrical contact between the battery and the contact plate 110. This will be done by a user when he wishes to put the light into use.

In an embodiment, the electric circuit 106 may be provided with an on/off switch 122. The on/off switch 122 can extend through an associated opening in the plate-shaped support element 104 and be accessible upon detachment of the light top 102 from the light frame 108. This may be advantageous when the LED-light is not going to be used for a while and, for instance, is to be stored for a prolonged time. Thus, the battery can be prevented from being discharged completely during this storage period.

The invention is not limited to the examples shown in the figures. The embodiments as claimed in the subclaims and which have been described above with reference to the drawing, may also be implemented differently. The embodiments can be combined with each other in different ways and also be used independently of each other. The reference numerals in the detailed description and in the claims are for clarification only and do not limit the claims.

The invention claimed is:

1. A LED-light comprising:

a light frame;

a light base connected with a first end of the light frame, wherein the light base is of substantially cylindrical design and has a central axis, wherein the light base is provided with an Edison thread extending concentrically around the central axis, or wherein the light base is provided with a bayonet fastener;

a number of LEDs mounted in or on the light frame;

at least one photovoltaic cell mounted in or on the light frame;

a battery connected with the light frame or the light base;

an electric circuit connected with the light frame or the light base and to which the number of LEDs, the battery and the at least one photovoltaic cell are connected, wherein the light frame at a first end thereof is detachably connected with the light base, wherein the light frame is a single injection-molded piece further provided with a battery chamber, wherein the battery chamber at the first end of the light frame is provided with a battery chamber opening via which a battery is insertable into the battery chamber, wherein the battery chamber opening is closable with the light base detachably connected with the light frame, wherein the light frame has a second end remote from the light base, wherein the LED-light further comprises a light-transmitting light top connected with the second end of the light frame, wherein the light top has a substantially spherical segment-shaped configuration, wherein the LED-light is provided with a substantially plate-shaped support element included in the light frame and provided with at least one opening, wherein the plate-shaped support element has two opposite main surfaces, a first of which faces the light base and a second of which faces the light top, wherein the electric circuit is mounted on the plate-shaped support element on the first side of the support element, wherein the LEDs mounted on the electric circuit extend through said associated at least one opening in the support element, such that the light emitted in use by the LEDs falls directly on the inner side of the light top, and wherein the at least one photovoltaic cell is mounted on the second side, facing the light top, of the plate-shaped support element, such that outside light falls via the light-transmitting light top onto the at least one photovoltaic cell.

2. The LED-light according to claim 1, wherein on the light base a contact is provided, the contact being electrically conductive and being in communication with the electric circuit, wherein the electric circuit is configured to place the LEDs into connection with the battery, so that the LEDs burn when there is a voltage on the contact, and wherein the electric circuit is configured to break the connection between the battery and the LEDs when there is no voltage on the contact, so that the LEDs do not burn.

3. The LED-light according to claim 1, wherein the Edison thread is of the type E27 according to IEC 60061-1 (7004-21) or DIN 49620 or is of the type E14 according to IEC 60061 (7004-23) or DIN 49615.

4. The LED-light according to claim 1, wherein the bayonet fastener is of the type B15d according to IEC 60061-1 (7704-11) or DIN 49721 or is of the type B22d according to IEC 60061-1 (7004-10).

5. The LED-light according to claim 1, wherein the light base is manufactured from plastic.

6. The LED-light according to claim 1, further comprising a wireless receiver configured for wireless communication with a transmitter, wherein the wireless receiver is part of the electric circuit, and wherein the electric circuit is configured to switch the LEDs on and off depending on a signal delivered by the wireless receiver.

7. The LED-light according to claim 1, further comprising a switch arranged on the light frame or the light base, the switch being a part of the electric circuit, wherein the electric circuit is configured to switch the LEDs on and off depending on the position of the switch.

8. The LED-light according to claim 1, wherein the light base is provided with electrically conductive contacts, wherein the electric circuit is configured to place the battery into connection with the contacts when the amount of stored energy in the battery is below a first threshold value, and wherein the electric circuit is configured to break the electrical connection between the battery and the contacts when the amount of stored energy in the battery is above a second threshold value.

9. The LED-light according to claim 1, wherein the battery is removable.

10. The LED-light according to claim 1, provided with an adapter terminal arranged for connection of an external supply adapter for the purpose of charging the battery.

11. The LED-light according to claim 1, wherein the at least one photovoltaic cell is in a plane extending perpendicular to the central axis and wherein a light-sensitive surface of the photovoltaic cell is remote from the light base, wherein the LEDs are so disposed as to radiate at least in the direction of the central axis, more specifically such that the radiation direction points away from the light base.

12. The LED-light according to claim 1, wherein the light base is further provided with a contact plate connected with the light base and forming the closure of the battery chamber and against which a battery placed in the battery chamber abuts by one end so as to form an electrical contact, wherein the contact plate is connected via an electrically conductive lead with the electric circuit for energizing the electric circuit by means of the battery and for charging the battery by means of the at least one photovoltaic cell.

13. The LED-light according to claim 12, wherein between the contact plate and a battery placed in the battery chamber an electrically insulating pull tab is provided, wherein the pull tab, prior to the LED-light being put into use, breaks the electrical contact between the battery and the contact plate, wherein the pull tab is engageable from an outside of the LED-light to enable it to be pulled away for establishing electrical contact between the battery and the contact plate.

14. The LED-light according to claim 13, wherein the electric circuit is provided with an on/off switch extending through an associated opening in the plate-shaped support element and being accessible when the light top is detached from the light frame.

* * * * *